United States Patent [19]

Moji et al.

[11] Patent Number: 4,759,727

[45] Date of Patent: Jul. 26, 1988

[54] CORD DETACHMENT PREVENTION DEVICE FOR MULTIELECTRODE CONNECTOR

[76] Inventors: Eirou Moji; Shuichi Miyake, both of 219, Iguchi, Mitaka-shi, Tokyo, Japan

[21] Appl. No.: 46,902

[22] Filed: May 5, 1987

[51] Int. Cl.[4] ..... H01R 13/58

[52] U.S. Cl. ..... 439/449; 439/610

[58] Field of Search ..... 439/607, 609, 610, 449, 439/455, 457, 658

[56] References Cited

U.S. PATENT DOCUMENTS 4,399,318 8/1983 Waters ..... 439/610 X 4,685,758 8/1987 Yoshida ..... 439/607 X

*Primary Examiner*—Eugene F. Desmond

*Attorney, Agent, or Firm*—Browdy and Neimark

[57] ABSTRACT

A cord detachment prevention device for a multi-electrode connector is disclosed, which comprises an outer sleeve consisting of a cylindrical metal member and provided at the rear end with a plurality of circumferentially suitably spaced-apart engagement pawl pieces, and a cord clamp having a gap portion and having a plurality of engagement pawl pieces provided on the outer periphery. The cord clamp is fitted on the outer periphery of a cord with the outer projections received in gaps between adjacent ones of engagement pawl pieces provided at the rear end of the outer sleeve. The cord clamp is fitted such that its gap portion is shifted in the circumferential direction relative to the butt faces of the metal plate of the outer sleeve and is joined to the rear end of the outer sleeve such that the outer projections are received in gaps between adjacent ones of the plurality of engagement pawl pieces so that the cord clamp is integrally assembled to the rear end of the outer sleeve with the bending of the engagement pawl pieces.

1 Claim, 5 Drawing Sheets

CORD DETACHMENT PREVENTION DEVICE FOR MULTIELECTRODE CONNECTOR

BACKGROUND OF THE INVENTION

1. Field of the Invention

This invention relates to a cord detachment prevention device for a multielectrode connector using an outer sleeve formed by processing a metal plate stamped into a cylindrical shape and serving as an outer electrode for preventing the detachment of a cord connected to a connector body.

2. Description of the Prior Art

A multielectrode connector using an outer sleeve consisting of a cylindrical metal plate has a problem that the diameter of the outer sleeve serving as an outer electrode is increased during use due to separation of the butt faces of the cylindrical metal plate.

When providing a cord detachment prevention device for preventing the detachment of a cord with cord lines thereof connected to a plurality of contacts assembled in a connector body, a C-shaped cord clamp having a gap portion is fitted on the outer periphery of an outer cover of the cord by spreading the gap portion, and subsequently the gap portion is closed. Consequently, the cord clamp is firmly secured to the outer periphery of the cord, and in this state the cord clamp is coupled to the connector body. By so doing, the operation of assembling the cord detachment prevention device is facilitated. In use, however, the gap portion of the closed cord clamp is spread to result in the looseness of coupling between the cord clamp and the cord. In such a case, the effect of prevention of the detachment of the cord can not be obtained.

SUMMARY OF THE INVENTION

The prevent invention has been intended to overcome the above problems, and its object is to provide a cord detachment prevention device for a multielectrode connector, with which the spread of an outer sleeve consisting of a cylindrical metal plate is effectively prevented by a cord clamp while also the looseness of the cord clamp itself is suppressed by the outer sleeve.

To attain the above object of the present invention, there is provided a cord detachment prevention device for multielectrode connector, which comprises an outer sleeve consisting of a cylindrical metal member and provided at the rear end with a plurality of circumferentially suitably spaced-apart engagement pawl pieces, and a C-shaped cord clamp having a gap portion and having a plurality of engagement pawl pieces provided on the outer periphery, the cord clamp being fitted on the outer periphery of a cord with outer projections received in gaps between adjacent ones of engagement pawl pieces provided at the rear end of the outer sleeve, the cord clamp being fitted such that its gap portion is shifted in the circumferential direction relative to the butt faces of the metal plate of the outer sleeve and is joined to the rear end of the outer sleeve such that said outer projections are received in gaps between adjacent ones of the plurality of engagement pawl pieces so that the cord clamp is integrally assembled to the rear end of the outer sleeve with the bending of the engagement pawl pieces.

BRIEF DESCRIPTION OF THE DRAWINGS

The object and feature of the invention will become apparent from the following description of a preferred embodiment of the invention with reference to the accompanying drawings, in which.

DETAILED DESCRIPTION OF THE PREFERRED EMBODIMENT

Figure 1:
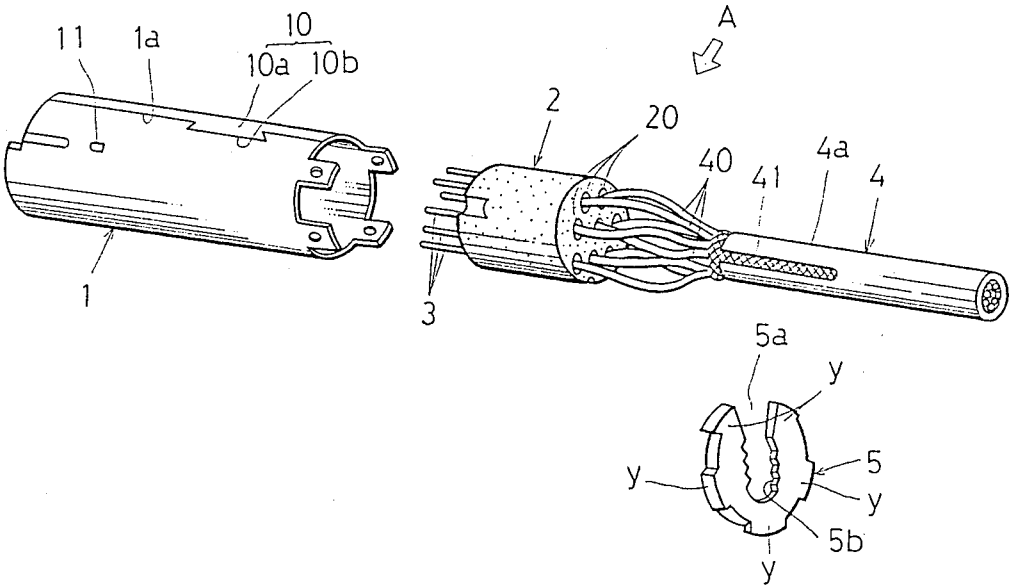
FIG. 1 is a perspective view showing a multielectrode connector being assembled incorporating the present invention.

FIG. 1 is a perspective view showing a multielectrode connector A being assembled for carrying out the present invention. Reference numeral 1 designates an outer sleeve consisting of a cylindrical metal plate, 2 a molding of a synthetic resin fitted like a plug in the outer sleeve 1, 3 contacts inserted through and held in respective through holes 20 formed in the molding 2, 4 a cord having cord lines 40 connected to terminals of the contacts 3 at the rear ends thereof, and 5 a cord clamp having a ring-like form for closing a gap portion 5*a*.

Figure 5:
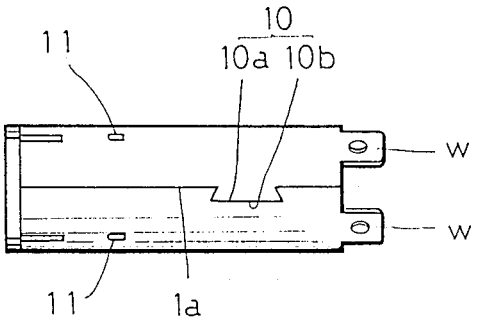
FIG. 5 is a plan view showing the outer sleeve of the connector.
Figure 6:
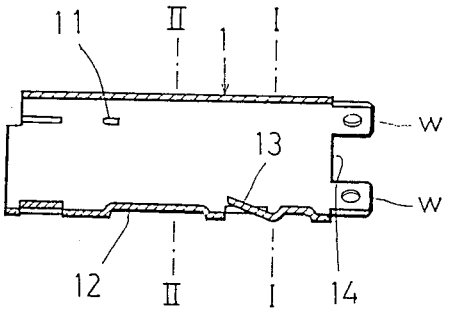
FIG. 6 is an axial sectional view of the outer sleeve of the connector.
Figure 7:
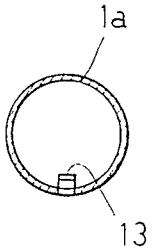
FIG. 7 is a sectional view taken along line I—I in FIG. 6 showing the outer sleeve.
Figure 8:
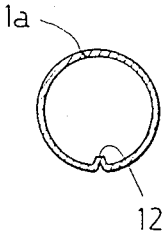
FIG. 8 is a sectional view taken along line II—II in FIG. 6 showing the outer sleeve.

The outer sleeve 1 is formed by processing a steel plate stampled to a predetermined shape and having a spring character with a press into a cylindrical shape. Axial butt faces 1*a* of the stamped steel plate, which are abutted when the steel plate is formed into the cylindrical shape, are provided with an engagement section 10 consisting of a wedge-like engagement projection 10*b* and a notch 10*b* having a complementary shape. The inner peripheral of the sleeve 1 near the front end is provided with stoppers 11 in the form of short ribs (FIG. 5) for restricting the position of the molding 2 fitted in the sleeve 1. The portion of the sleeve 1 opposite to the butt faces 1*a* is provided with a guide rib 12 serving as a guide when inserting the molding 2 and also with a stopper pawl 13 for restricting the return of the fitted molding 2 (FIGS. 6 to 8).

Figure 4:
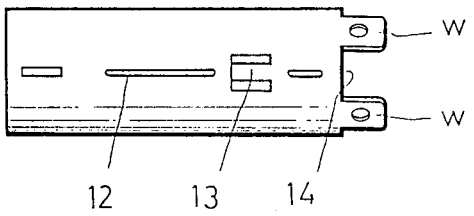
FIG. 4 is a bottom view showing an outer sleeve of the connector.

Engagement pawl pieces w extend from the rear end of the outer sleeve 1. They are formed integrally with the steel plate when stamping the steel plate material. As shown in FIGS. 4 and 5, they extend rearwardly from the rear end 14 of the outer sleeve 1. As shown in FIGS. 4 and 5, the engagement pawl pieces w are provided at positions dividing the circumference of the rear end of the outer sleeve 1 into four uniform sections. Of these engagement pawl pieces w, adjacent two are provided on the opposite sides of the butt faces 1*a* (FIG. 5).

Figure 9:
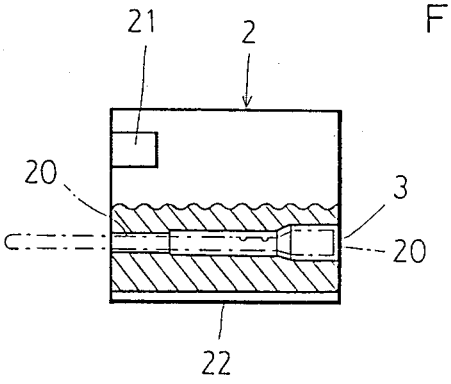
FIG. 9 is a side view, partly broken away, showing a molding of the connector.
Figure 10:
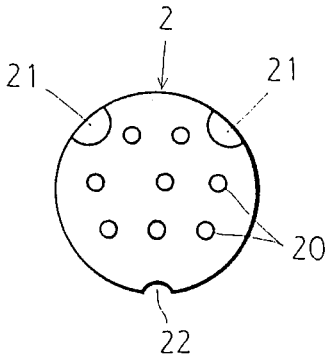
FIG. 10 is a front view showing the molding.
Figure 11:
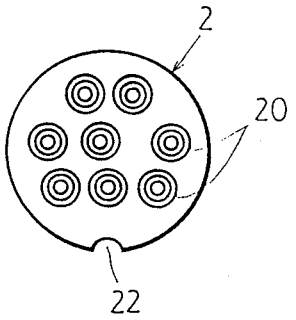
FIG. 11 is a rear view showing the molding.

The molding 2 has the axial through holes 20 (extending to the left and right in FIG. 9), in which the contacts 3 are inserted and held, as shown in FIGS. 9 to 11. The front end (left end in FIG. 9) of the outer periphery of the molding 2 are provided with recesses 21, in which the stoppers 11 are engaged. The outer periphery of the molding 2 is also formed with an axial guide groove 22 open at the opposite ends, in which the guide rib 15 noted above is engaged.

Figure 2:
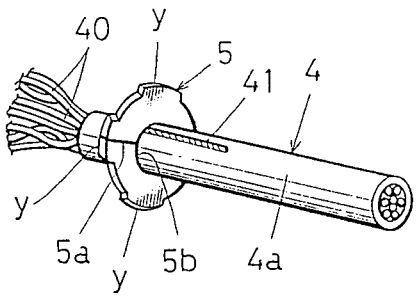
FIG. 2 is a perspective view showing a cord, on which a cord clamp of the connector is fitted.

The cord clamp 5 is a metal member free from the spring character. As shown in FIG. 1, it is a C-shaped metal member having the gap portion 5*a*. It is fitted from the gap portion 5*a* on the outer periphery of an outer cover 4*a* of the cord 4, and then the gap portion 5*a* is closed. Consequently, the inner periphery of a central hole portion 5*b* wedges on the outer periphery of the outer cover 4*a* of the cord 4, whereby the cord clamp is tightly integrally coupled to the cord 4, as shown in FIG. 2. The cord clamp consists of a metal member having the spring character of a synthetic resin member. As shown in FIG. 2, the inner periphery of the central hole portion 5*b* wedges on the outer periphery of the outer cover 4*a* of the cord 4, and the gap portion 5*a* is spread by spring pressure into a state as shown in FIG. 1. In this state, the cord clamp is fitted on the outer periphery of the outer cover 4*a* of the cord 4, and the expanding force is released, whereby the cord clamp is coupled to the outer periphery of the cord 4 as shown in FIG. 2.

Figure 3:
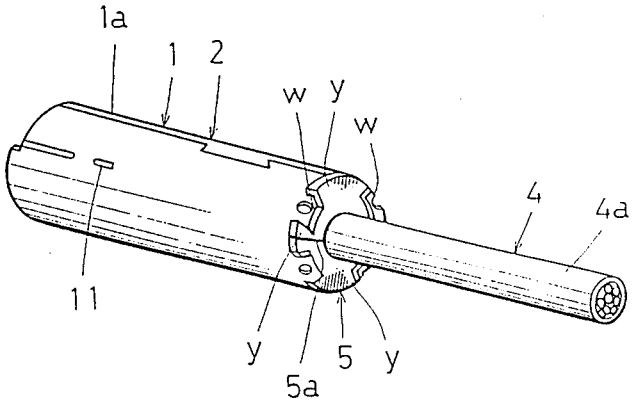
FIG. 3 is a perspective view showing a connector body, on which the cord clamp of the connector is assembled.

The outer periphery of the cord clamp 5 is provided with a plurality of outer projections y. As shown in FIG. 4, the outer projections y are radially spaced-apart at positions uniformly dividing the circumference of the cord clamp 5 into four sections. They each have a width to be closely engaged in the gap between adjacent engagement pawl pieces w provided at the rear end of the outer sleeve 1 in the close state of the gap portion 5*a* of the cord clamp 5 and have a height such that the projecting end overlaps at least the rear end 14 of the outer sleeve 1 with the cord clamp 5 joined to the rear end of the outer sleeve 1 as shown in FIG. 3. The outer projections y provided on the outer periphery of the cord clamp 5 are fitted in the gaps between adjacent engagement pawl pieces w of the outer sleeve 1 so that the cord clamp 5 is not rotated in the circumferential direction relative to the outer sleeve 1. The number of the outer projections y corresponds to the number of engagement pawl pieces w formed on the rear end of the outer sleeve 1.

With the cord clamp 5, the molding 2 holding the contacts 3 connected to the cord lines 40 of the cord 4 is inserted into the outer sleeve 1 with the cord clamp 5 tightly fitted on the outer periphery of the outer cover 40 of the cord 4, the cord clamp 5 is joined to the rear end of the outer sleeve 1, and the outer projections y are fitted in the gaps between adjacent engagement pawl pieces w such that the position of the gap portion 5*a* of the cord clamp 5 is shifted in phase in the circumferential direction with respect to the butt faces 1*a* of the outer sleeve 1 (FIG. 3). The cord clamp 5 joined to the rear end of the outer sleeve 1 is integrally assembled on the outer sleeve 16 by caulking each engagement pawl piece w of the outer side of the cord clamp 5.

In the illustrated embodiment of the device, reference numeral 7 designates a synthetic resin cover molded on a region from the outer periphery of a rear half of the outer sleeve 1 to the outer periphery of an end portion of the cord 4, 15 a positioning notch serving as a positioner when inserting the front end of the outer sleeve 1 into the corresponding part of the multielectrode connector, and 41 shield wires wrapping the outer periphery of the cord lines 40.

The embodiment of the device having the above construction is operated in the following way.

Figure 12:
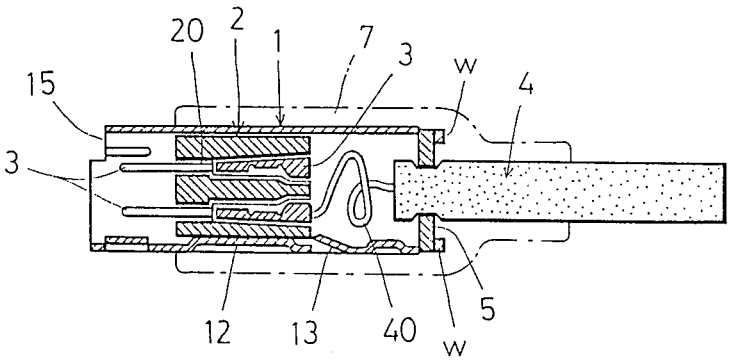
FIG. 12 is an axial sectional view showing the multielectrode connector in an assembled state.

Since the cord clamp 5 mounted on the rear end of the outer sleeve 1 of a connector body a is integrally coupled to the outer sleeve 1 in a state embraced by the engagement pawl pieces w provided at the rear end of the outer sleeve 1, when the cord 4 is pulled to the right in FIG. 12, the cord 4 can be reliably prevented from being pulled away from the connector body a.

With this cord clamp 5, the outer projections y provided on the outer periphery are closely engaged in gaps between adjacent engagement pawl pieces w provided on the rear end of the outer sleeve 1, and the gap portion 5*a* is located at the outer projection y. Therefore, the gap portion 5*a* is clamped between the engagement pawl pieces w of the outer sleeve 1 and is not expanded. It is thus possible to eliminate the expansion of the gap portion 5*a*.

With the outer sleeve 1 the engagement pawl pieces w provided on the opposite side in the circumferential direction of the butt faces 1*a* of the cylindrical steel plate are confined in gaps between adjacent outer projections y of the cord clamp 5 so that they are not movable in the circumferential direction. Thus, it is possible to reliably prevent the separation of the butt faces 1*a*. Further, since the cord clamp 5 consists of a metal member and closes the rear end of the outer sleeve 1, it also serves as effective measure against electromagnetic wave interference.

As has been described in the foregoing, with the cord detachment prevention device for a multielectrode connector according to the present invention the cord clamp having the gap portion is secured to the rear end of the outer sleeve such that it is not movable in the circumferential direction by shifting the positions of the gap portion and butt faces of the outer sleeve in the circumferential direction and through the meshing between a plurality of radially spaced-apart outer projections provided on the cord clamp and a plurality of engagement pawl pieces provided on the rear end of the outer sleeve, and is secured against axial movement relative to the outer sleeve by the caulking of the engagement pawl pieces. Therefore, although use is made of the cord clamp with the gap portion, no looseness is produced, and it is also possible to prevent the spread of the butt faces of the outer sleeve.

What is claimed is:

1. A cord detachment prevention device for a multielectrode connector comprising:

an outer sleeve consisting of a cylindrical metal plate member having butt faces and provided at the rear end with a plurality of circumferentially suitably spaced-apart engagement pawl pieces; and a ring-like formed cord clamp having a gap portion and having a plurality of engagement pawl pieces provided on the outer periphery;

said cord clamp being fitted on the outer periphery of a cord with the outer projections received in gaps between adjacent ones of engagement pawl pieces provided at the rear end of said outer sleeve;

said cord clamp being fitted such that its gap portion is closed and is rotated about the longitudinal axis of said cord relative to the butt faces of the metal plate member of said outer sleeve and is joined to the rear end of said outer sleeve such that said outer projections are received in gaps between adjacent ones of said plurality of engagement pawl pieces so that said cord clamp is integrally assembled to the rear end of said outer sleeve with the bending of said engagement pawl pieces.

* * * * *